US005353448A

United States Patent [19]

Lee

[11] Patent Number: 5,353,448

[45] Date of Patent: Oct. 11, 1994

[54] WATER RECYCLING SYSTEM USING SPENT RECYCLED WATER WITH FRESH WATER

[76] Inventor: Gary M. Lee, 4008 Van Noord, Studio City, Calif. 91604

[21] Appl. No.: 906,418

[22] Filed: Jun. 30, 1992

[51] Int. Cl.[5] ..... A47K 3/22

[52] U.S. Cl. ..... 4/597; 4/567; 4/601

[58] Field of Search ..... 4/546, 567, 568, 570, 4/597, 601, 602, 603, 615, 616, 665, 559, 541.1, 541.3, 541.4, 541.6

[56] References Cited

U.S. PATENT DOCUMENTS

| | | | |
|---|---|---|---|
| 2,308,452 | 1/1943 | Ortyl | 4/603 |
| 3,341,865 | 9/1967 | Vance | 4/570 |
| 3,606,618 | 9/1971 | Veech | 4/603 |
| 3,717,142 | 2/1973 | Mickelson | 4/570 X |
| 4,224,700 | 9/1980 | Bloys | 4/603 |
| 4,893,364 | 1/1990 | Keeler | 4/603 X |
| 5,165,456 | 11/1992 | Woolman | 4/597 X |

FOREIGN PATENT DOCUMENTS

| | | | |
|---|---|---|---|
| 2432292 | 4/1980 | France | 4/602 |
| 2565811 | 12/1985 | France | 4/597 |

*Primary Examiner*—Robert M. Fetsuga
*Attorney, Agent, or Firm*—Robert J. Schaap

[57] ABSTRACT

A water recycling system primarily adapted for use in shower facilities enabling the user to increase both the time duration of a shower and the quantity of water experienced by a user, by maintaining water in a semi-closed system, while both maintaining water and energy conservation. The system preferably operates with fresh and recirculated hot water. The system utilizes spent hot shower water located in the catchment area of a shower or tub and recycles this water to one or more spray heads located at or in the proximity of the regular water dispensing head or so-called "spray head" of that shower. A selected water temperature can be maintained by periodically introducing fresh water or continuously introducing the fresh water at a very low flow rate from a fresh water source, and mixing that water with the recycled water from a water catchment area. Recycled water can also be re-heated and issued again. The apparatus of the system may be provided with an adapter for quick connect and disconnect such that the apparatus can be moved from shower to shower. A manifold forming part of the apparatus includes a check valve arrangement to preclude gray water or spent hot water from entering into the water supply system.

17 Claims, 9 Drawing Sheets

WATER RECYCLING SYSTEM USING SPENT RECYCLED WATER WITH FRESH WATER

BACKGROUND OF THE INVENTION

1. Field of the Invention

This invention relates in general to certain new and useful improvements in a water recycling system and more particularly, to a water circulation system which is highly effective for use in recycling water from a water catchment basin, e.g. of a shower and reissuing the same a through dispensing head along with an intermittent mixing of fresh water from a supply source.

2. Brief Description of the Prior Art

In many parts of the United States and other countries throughout the world, there are periodic draught conditions which may last for one or more years. In many other countries there is a permanent drought condition as a result of geographic locale and the climatic conditions for that geographic area and hence a chronic shortage of fresh consumable water. As a result, water becomes a precious commodity. Various governmental institutions, as a matter of necessity, impose restrictions on the quantity of water which may be used. These restrictions generally apply to commercial institutions such as hotels and industrial users, as well as to private users.

Coupled with the problem of rationing is the fact that many municipalities have severe restrictions on the use of waste water or gray water and also have restrictions on the use of underground water sources since these sources may potentially be contaminated. As a result of these restrictions, and the rationing of water, one of the principal uses to which water conservation is directed is shower wash water.

Many municipalities, in water shortage periods, instruct the citizens to use shower water only for purposes of rinsing off soap lather, and to cease all water flow during lathering and the like. Moreover, by governmental regulation, all homes in certain municipalities must be outfitted with flow-restricting shower nozzles which materially reduce the water flow rate and hence, the reduction in the quantity of water which issues from a shower head.

The problem of water rationing is particularly pronounced in countries which do not have a large available source of fresh water. Many countries have resorted to the use of desalination plants for purposes of producing fresh water from sea water. However, with the present-day technology, the cost of desalinized water is quite substantial and while there may not be a supply restriction, the cost of the water is quite substantial and therefore, there is an effective economic restriction on the amount of water which can be used in any activity.

Many people are accustomed to and particularly enjoy long showers with an abundance of available hot water. Not only does the flow restricting head reduce the amount of water delivered, but since the flow restricter literally serves as a restriction in the line, water issues at a substantial pressure. As a result, there is not a soft water flow, but rather a high pressure stream of water which does not produce a pleasing sensation when striking upon a person's body in any significant quantity which users may desire.

In many societies of the world, bathing is often a tradition or a ritual. Thus, even if sources of fresh water are readily available, there is still a cost associated with purification and delivery of water from a public source to private facilities. Thus, water conservation still has substantial cost benefits. Further, the bathing is oftentimes not only a traditional ritual, but does provide many aesthetic benefits, as well as therapeutic benefits. Thus, water recycling has a significant advantage in essentially all societies.

When one replaces a government issued or government approved flow-restricting shower head with another high-flow rate conventional shower head, that person risks potential civil penalties, not to mention the substantial cost for exceeding a rationed limit of water. Hotels and similar institutions have a particularly pronounced problem in that there is no effective control on the quantity of shower water used by a temporary occupant. Nevertheless, hotels and similar institutions are almost always subjected to rationing of water on the same basis as the private population. Consequently, these institutions have a particular need for some mechanism to control the amount of water used or otherwise to provide a water-conserving shower bath system.

In view of the foregoing, there is clearly a need of water rationing in those regions where only a limited amount of fresh water may be available, particularly in vehicles such as boats, planes, trains, submarines, space stations, recreational vehicles, mobile homes and the like. These vehicles in particular are uniquely limited in their ability to provide extended shower capacity, due to the finite capacity of water on board the vehicle, or otherwise the ability of the vehicle to create fresh water. Thus, a water recycling system in this type of environment would be particularly effective.

In addition, closely related to the need for water conservation is the problem of energy consumption. The heating of water alone accounts for a substantial energy use in many countries. For those institutions and private residences for reasons of minimizing expense and conserving energy resources and reducing the associated pollution, the reduction of the need to heat water may become as vital a goal as the conservation of the water itself. Use of all forms of heating energy, such as fossil fuel energy, electrical energy and the like, results in increased costs. Further, many commercial and industrial institutions, and the private sector in general, have found it necessary to also restrict the use of fossil fuel energy, as well as restrict the use of water consumption.

In addition to the restrictive constraints on the availability, cost and ecology of heating energy, is the basic limitation or capacity of the supply source to meet the demand. As a simple example, if a hot water heater is limited in its ability to provide sufficient yield when successive and/or multiple demands are placed on this heating system, the consequence of depleting and utilizing all of the available hot water are frequent. In a household environment, with a limited hot water supply capacity, only a limited number of family members can shower within a limited time period without otherwise depleting the availability of hot water. As a result, the traditional therapeutic and healthful ritual of bathing is often degraded into a brief, unsatisfying guilt-ridden utilitarian function of merely cleaning.

The present invention obviates these and other problems in the provision of a water recycling apparatus and method which is highly effective for use in showers and which maintains both energy and water conservation, while greatly improving performance, capacity and satisfaction.

OBJECTS OF THE INVENTION

It is, therefore, one of the primary objects of the present invention to provide a hot water recycling apparatus which is highly effective for use in showers and which maintains both energy and water conservation.

It is another object of the present invention to provide a hot water recycling apparatus of the type stated in which water in the catchment area of a shower stall is recycled to a shower head for reissuance from a shower head.

It is a further object of the present invention to provide a hot water recycling apparatus of the type stated which operates in conjunction with hot water issued from a fresh hot water supply source to maintain a desired temperature.

It is a salient object of the present invention to provide a system and a method in which an increased volume of water is delivered and available to a user while still providing fresh hot water to a user and without increasing the quantity of fresh hot water which would otherwise be employed.

It is an additional object of the present invention to provide a hot water recycling apparatus of the type stated which is capable of providing a substantial water flow rate and with a quantity of water issued under relatively lower pressure or at least as low as the pressure that would be obtained with flow restricters in the supply line.

It is still another object of the present invention to provide a hot water recycling apparatus of the type stated which is constructed so as to avoid any possibility of gray water introduction into, and hence contamination of, a fresh water supply source.

It is yet another object of the present invention to maintain an available supply of hot water while effectively increasing the amount of hot water which is utilized in shower activities and maintaining an almost constant temperature in all shower activities, whether in simultaneous or immediately consecutive shower activities.

It is another salient object of the present invention to provide a system for treating, heating, filtering and/or dechlorinating shower water, while at the same time increasing the availability of hot water use.

It is also an object of the present invention to provide method of recycling hot water by utilizing a shower basin catchment water and reissuing the same in conjunction with fresh hot water at a reduced flow rate from a fresh water supply source.

It is still another salient object of the present invention to provide a hot water recycling system which can be utilized in new shower construction or in existing shower construction as a retrofit device.

It is still a further object of the present invention to provide a method of operating a shower bath using recycled hot water from the catchment area of a shower basin and which is recycled to a shower head for reissuance from a shower head and which may operate in conjunction with hot water issued from a fresh hot water supply source to maintain a desired temperature.

With the above and other objects in view, my invention resides in the novel features of form, construction, arrangement and combination of parts presently described and pointed out in the claims.

BRIEF SUMMARY OF THE INVENTION

The present invention relates in general to a water recirculating system which allows the controlled mixing of spent water with fresh water from a fresh water source, and which is highly effective for use in showers. This water recycling system relies upon a re-use of water, preferably hot water, collected in the catchment area of a shower stall and which may also be used in conjunction with a limited amount of water, e.g. hot water, from a supply source in a manner to be hereinafter described in more detail. The fresh hot water may be added intermittently to the recycled hot water, or otherwise, it may be added at a continuous low-volume flow rate, for example, in a proportion of one-tenth or one-twentieth of the amount of hot water which is being recycled.

While the present invention is highly effective for use in recycling hot water in shower stalls, it should be understood that the invention is not so limited. Thus, the invention could find use in areas other than shower stalls in which it is desired to reuse hot water which has not been substantially soiled. Thus, the system of the invention is highly effective for use in bathtubs and like environments. However, and notwithstanding, the invention has been designed primarily for and is particularly useful in shower bath installations.

The hot water recycling system of the invention includes both an apparatus as well as a method of using the same. The apparatus of this invention includes a manifold which receives water from the catchment area of a shower basin through a spent water delivery tube. A plug or other drain control member is placed in or over the drain hole of the shower basin in order to restrict or stop water from draining through the drain pipe. The water which is located in the catchment area to a large extent is still relatively clean and moreover, is still hot. Consequently, when that water is allowed to drain, there is a complete waste of relatively clean, heated water, as well as a waste of the energy used for the heating of that water.

The present invention takes advantage of this collected hot water by utilizing a small pump in the nature of a sump or drain pump to pump the water from the catchment basin back up to a reissuing shower head. A manifold allows the recycled water to reissue from the reissuing head. In short, there is a recirculation system in which water from the basin of the shower is recycled to one or more spray heads at a temperature which may be selected by the user. The recirculated water may be re-issued at a rate which may be of higher volume and pressure equal to or less than a standard water-saving shower head.

The recycled water will, from time to time, or otherwise continuously require an additional source of heat, depending on rate of use. Consequently, a fresh amount of hot water from the fresh water supply source, such as a hot water heater, may be mixed with the recycled water in the desired proportion. Here again, the user of the apparatus can select that quantity of new hot water to be mixed with the recycled hot water. Many governmental organizations have severe restrictions on the mixing of so-called "gray water" with fresh so-called "purified" water. The present invention complies with those restrictions in that the manifold includes the backflow restriction which may exist in the nature of a check valve. In this way, there is no possibility of any of the recycled water being mixed in the supply line with the fresh or purified water.

Many people might object to the use of recycled hot water which has soap mixed in with that water. Consequently, in these cases, the hot water which is used for creating a lather and for rinsing that lather from the person, can be rinsed from the person and allowed to drain. Thereafter, a plug or other drain control restriction may be located in or on the drain pipe and the water collected in the catchment basin can be recycled as previously described.

The present invention provides a water recycling system which may be fully integrated with the existing fresh water supply as in a new construction, or otherwise, it may be provided as a subsequent retrofit apparatus, as aforesaid. When used in a new construction, many of the components, such as the actual diverter valve or other form of manifold and, for that matter, the pump, may be located either under the floor of the structure holding the shower or otherwise, behind the wall so that these components are unobtrusive and out of sight. When used as an addition to an existing fresh water supply source, such as the existing spray head in a shower, the water recycling apparatus of the invention can be packaged as a small, compact unit so that it does not consume any substantial amount of floor space in a shower stall or similar shower bathing facility. Further, the pump itself may be located outside of the shower stall and attached to a wall, hung or suspended from existing hardware, or otherwise integrated into the supply stem of the fresh hot water source.

The water recycling apparatus of the present invention may also be provided in the form of a stand-alone unit, such that it is not connected to the existing hot water supply. In this case, the apparatus would operate independently of the hot water supply and the user could independently operate the hot water supply in the shower stall and simultaneously or intermittently operate the stand-alone water recycling apparatus.

In essentially all embodiments of the hot water recycling system of the invention, water is recycled and emitted from either the auxiliary spray head or the existing fresh water supply spray head at a substantially high flow rate, but at a very low pressure. Normally, where the existing water supply head is a so-called "water saving head", and, for that matter, many of the conventional non-water saving shower heads, emit water at a much lower flow rate and under a relatively high pressure.

By using recycled water with the apparatus and method of the present invention, it is possible to emit water at a rate of about four to about twenty gallons per minute, whereas water is ejected from a standard conventional water spray head at about five to six gallons per minute, and from a water saving, energy conserving or water conservation spray head at a rate of about one to three gallons per minute. Nevertheless, the amount of hot water which is used to supplement the recycled water, when recycled at a rate of about twenty gallons per minute, is no more than one gallon per minute maximum, and usually about one quart per minute or less, depending on the user's requirements and design of stall and external environment.

The present invention provides a method of reusing hot water issued from a shower head by utilizing the aforesaid apparatus. In this case, the user can control the amount of water recycled and the amount of newly issued water as aforesaid.

The water which issues from a fresh water shower head will, to some extent, cool when passing from the shower head to the catchment area of the shower stall or other shower facility. Some cooling may also be inherent in the recirculation process. Thus, and to this extent, while the water still has a substantial amount of heat, it may be characterized as "warm" water, whereas the fresh water issuing from the shower head may be characterized as "hot" water. Nevertheless, in terms of the present invention, inasmuch as the recirculated water has a substantial heat content, it is often referred to as "hot" water.

A drain control member forms part of the apparatus and is used with the method of the present invention when employed in connection with a conventional shower stall. Several embodiments of effective drain control members are disclosed herein. These drain control members are adapted to extend over the drain in the shower basin and serve to limit the level of accumulated hot water in the shower stall. The drain control members are designed to permit water to accumulate within the catchment area to a user-selected depth. Beyond this predetermined depth, water will flow through the drain control member and into the existing drain pipe. In this way, there is a ready supply of hot water within the catchment area for ultimate reissuance from the spray heads, while freeing the user from having to vigilantly monitor the rising accumulation of water which might overflow the shower sill.

While the present invention has been described in connection with the use of recycled hot water, it should be understood that the invention is not so limited in its utility. Thus, and while it is preferable to recycle hot water for purposes of water conservation, as well as energy conservation, it is also possible to recycle water which has not been heated, particularly in areas of chronic water shortage. Further, the invention is not limited necessarily to the recycling of pure water alone. Other additives or chemical compositions may be added to the water and recycled along with the spent water itself. As a simple example, a medicament which may be applied to a person's skin for surface treatment thereof might be initially rinsed from a person's skin, but which would nevertheless be entrained in the spent hot water and recycled and reissued for subsequent contact with the person's skin.

The present invention has many other advantages and fulfills many other purposes and which will all become apparent from a consideration of the form in which this invention may be embodied. Several embodiments of the invention are illustrated in the accompanying drawings and described in the detailed description of this invention. However, it is to be understood that these drawings and the detailed description are set forth only for purposes of illustrating the general principals of the invention and are not to be taken in a limiting sense.

BRIEF DESCRIPTION OF THE DRAWINGS

Figure 1:
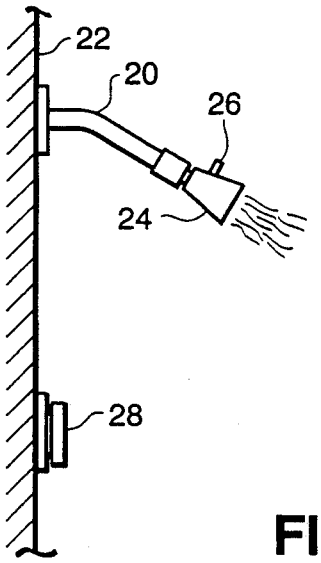
FIG. 1(Prior Art)
Figure 2:
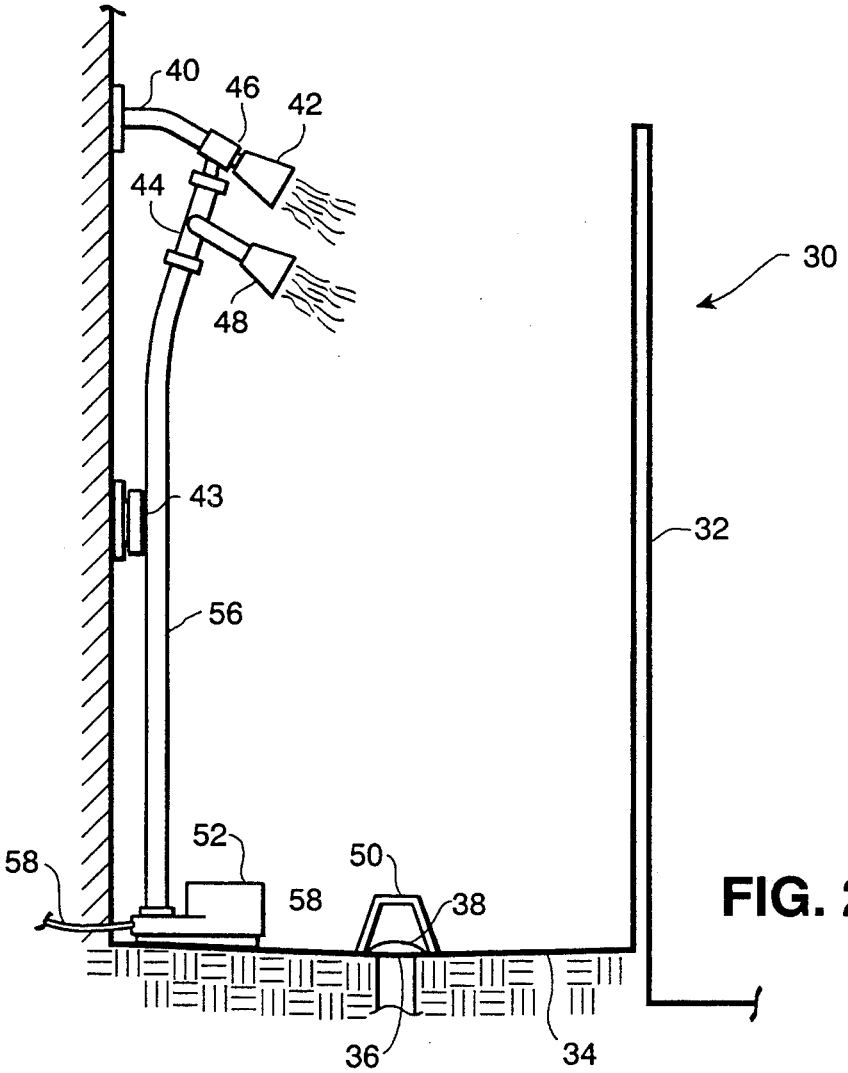
Figure 3:
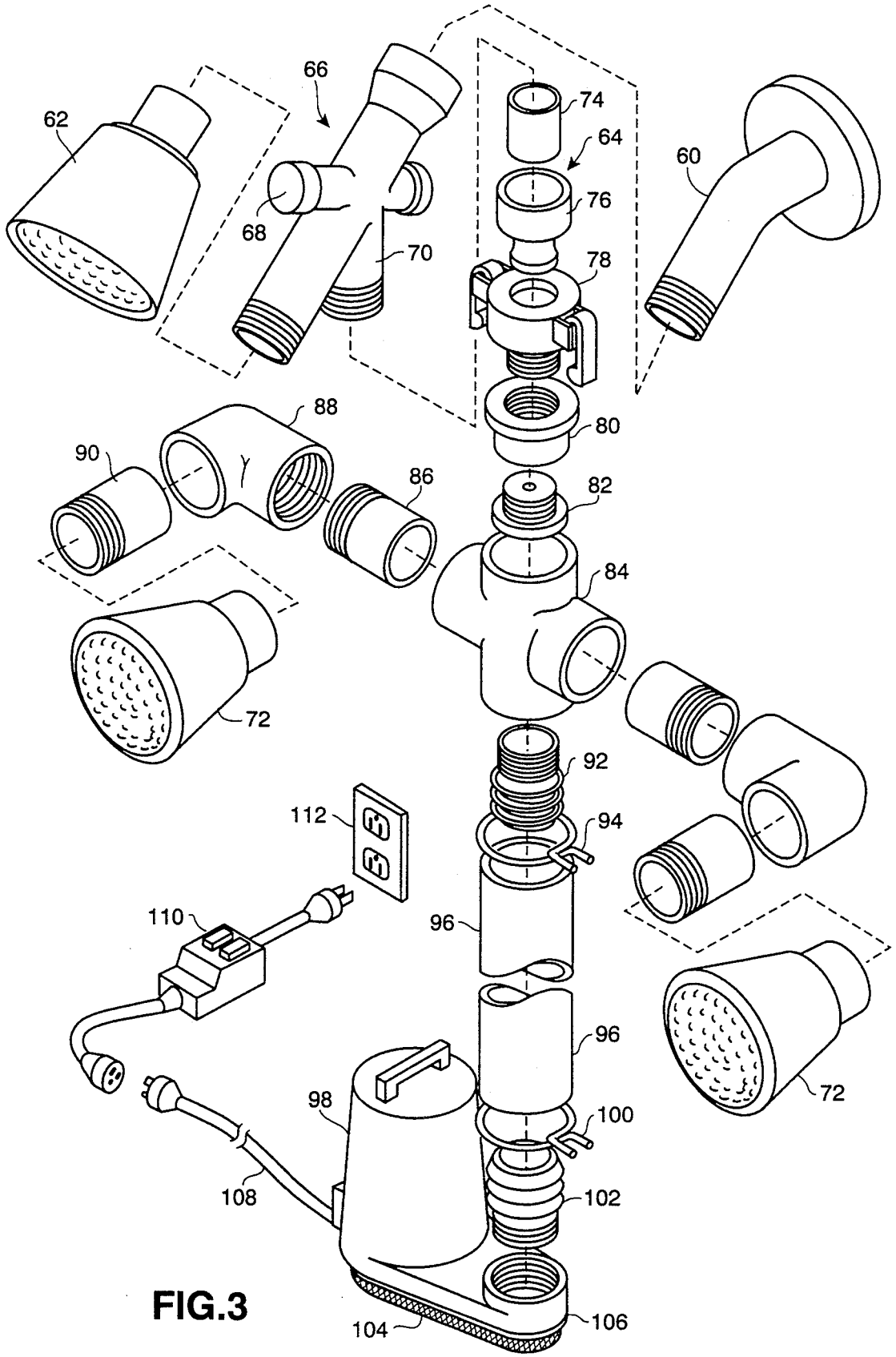
Figure 3A:
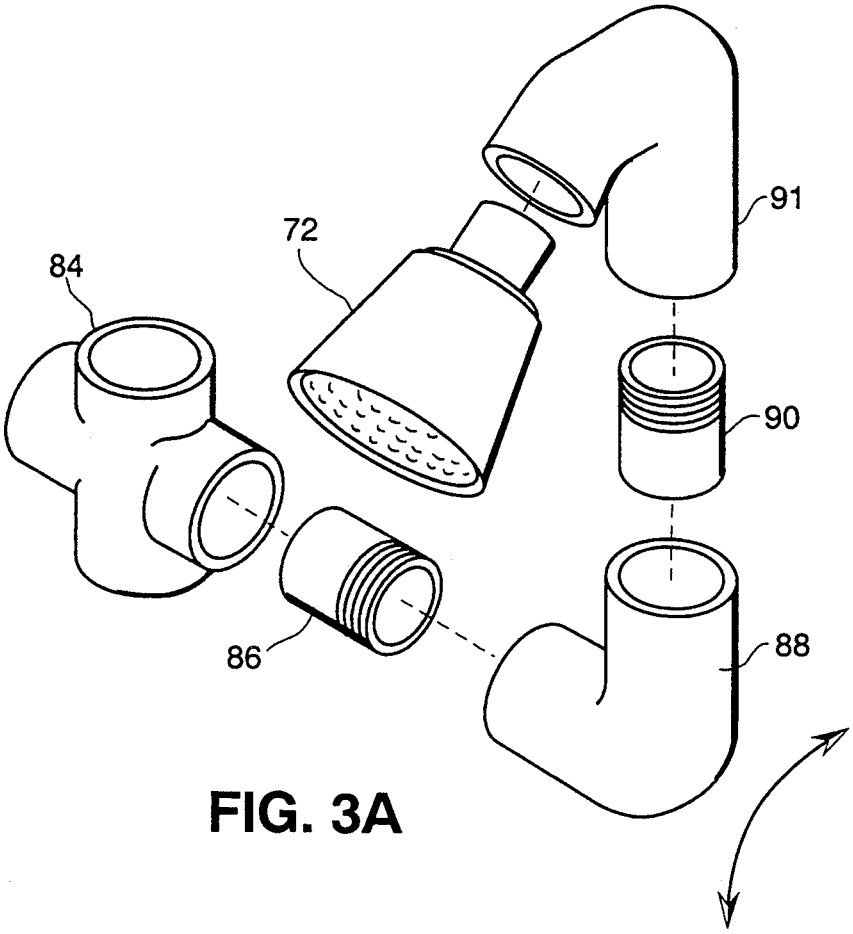
Figure 25:
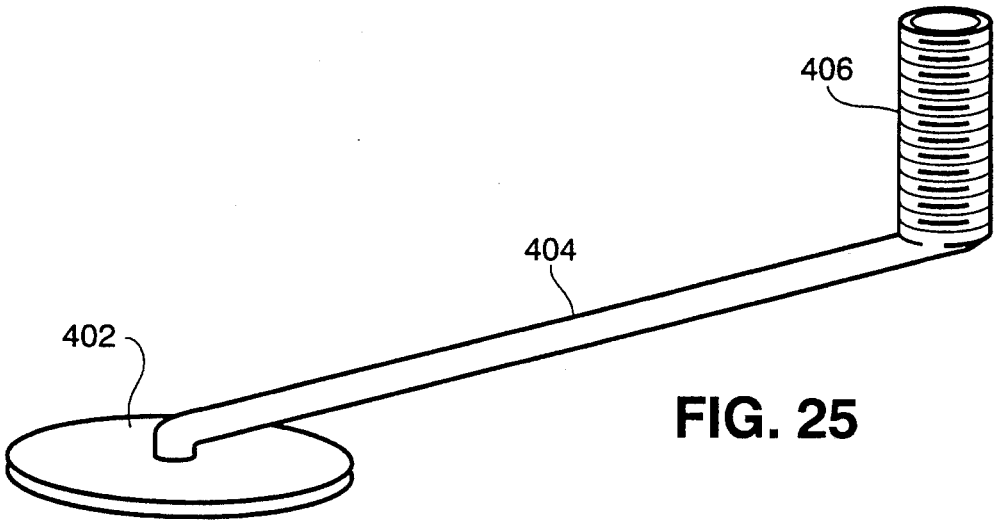
Figure 4:
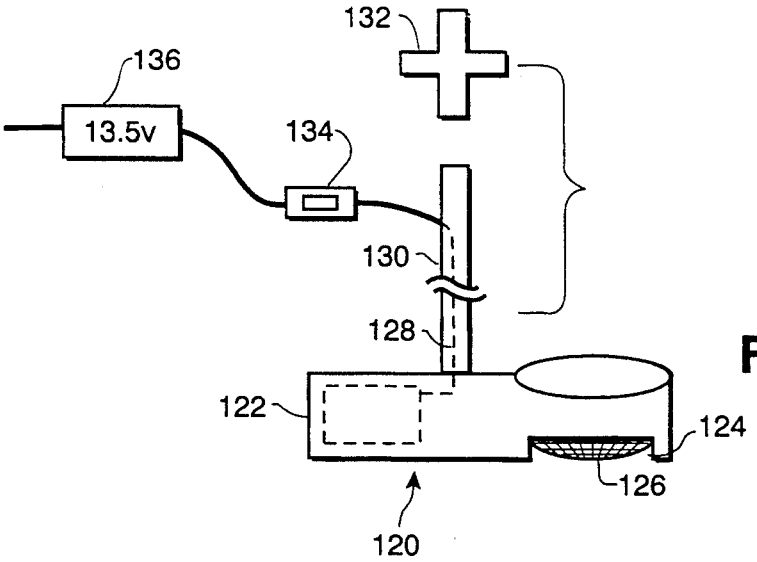
Figure 5:
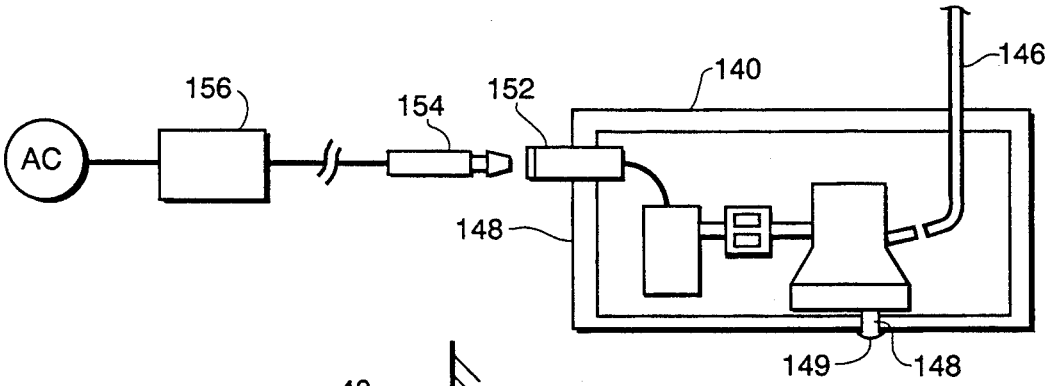
Figure 6:
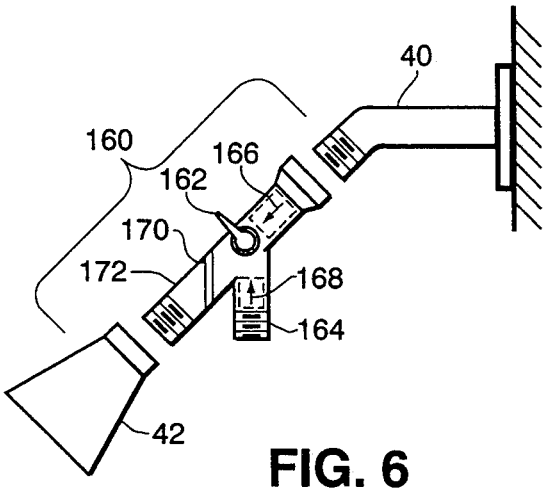
Figure 7:
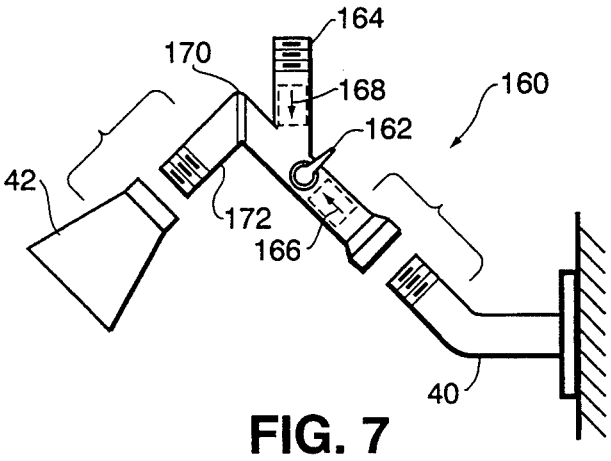
Figure 8:
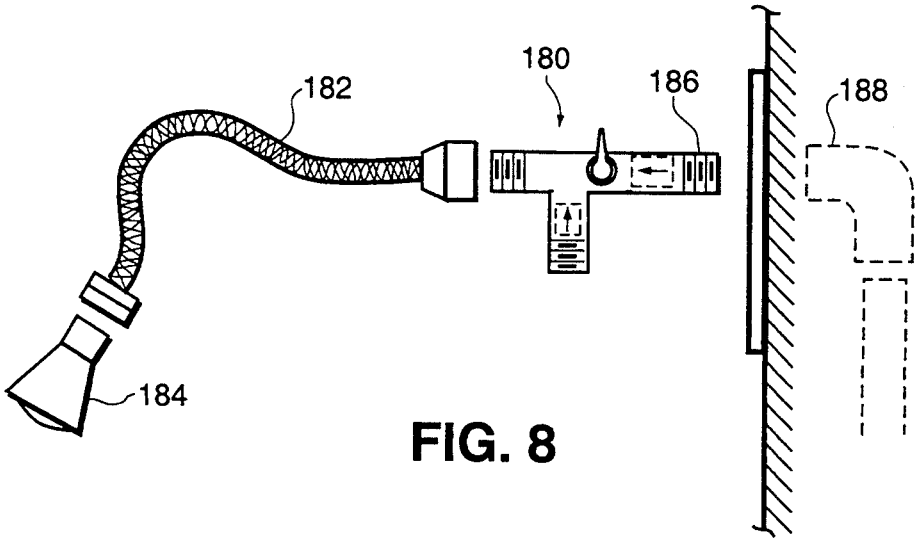
Figure 9:
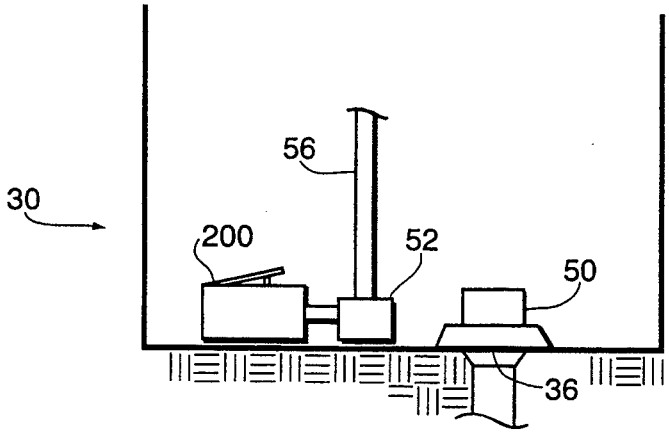
Figure 10:
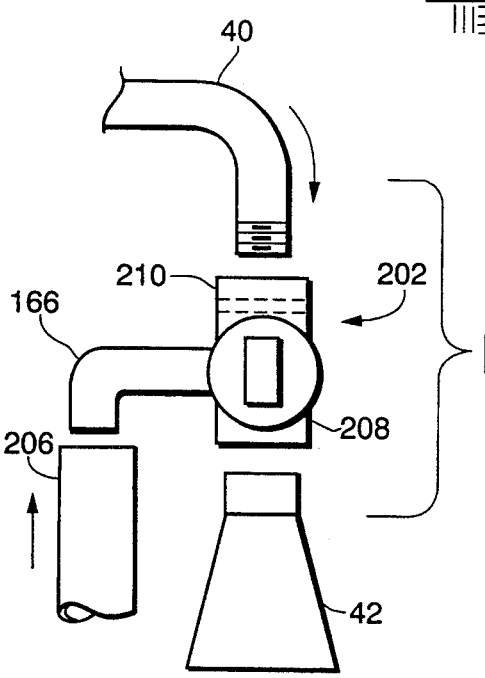
Figure 11:
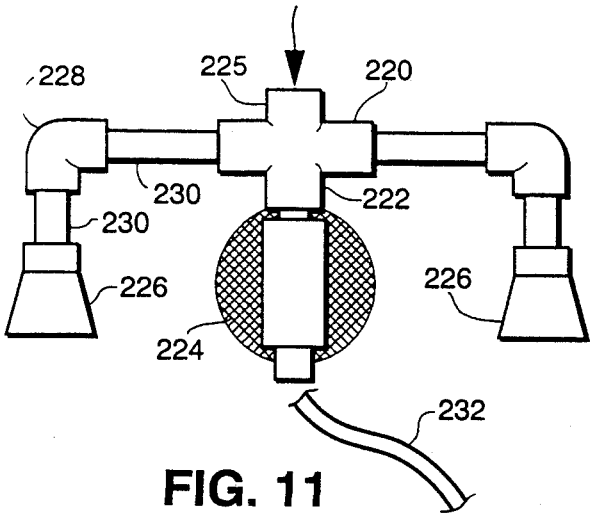
Figure 12:
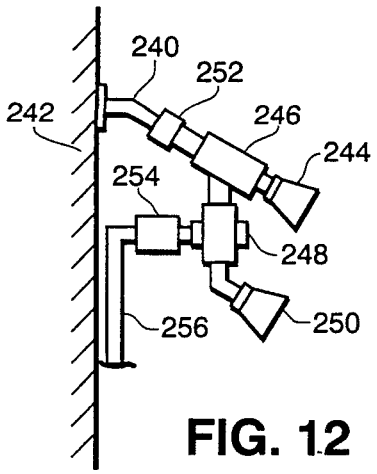
Figure 13:
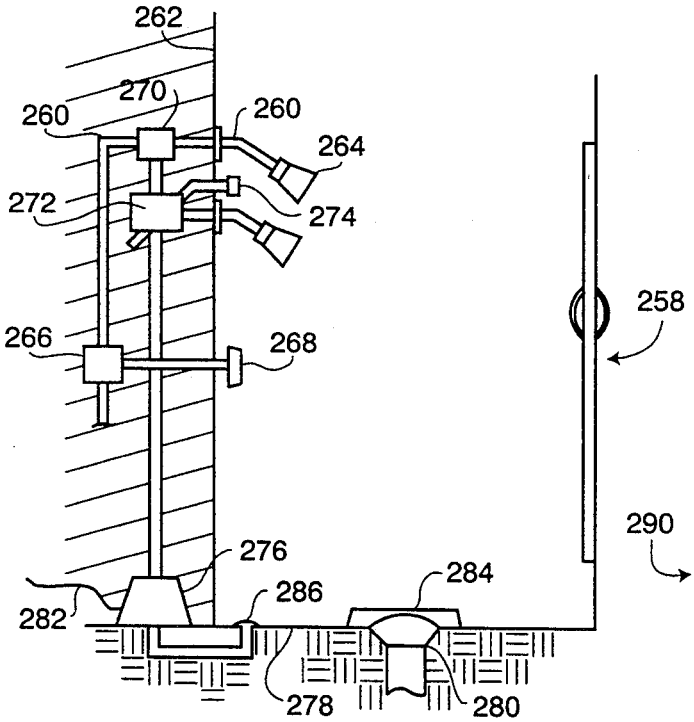
Figure 14:
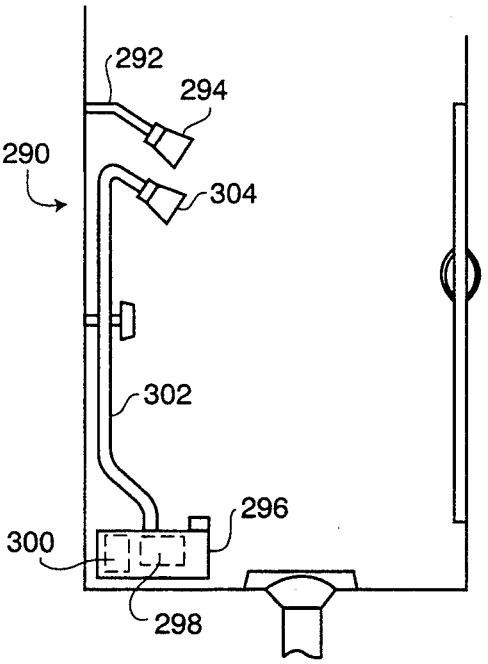
Figure 15:
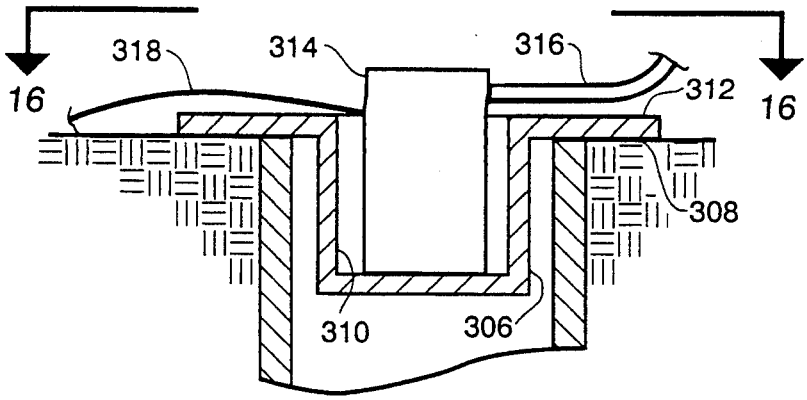
Figure 16:
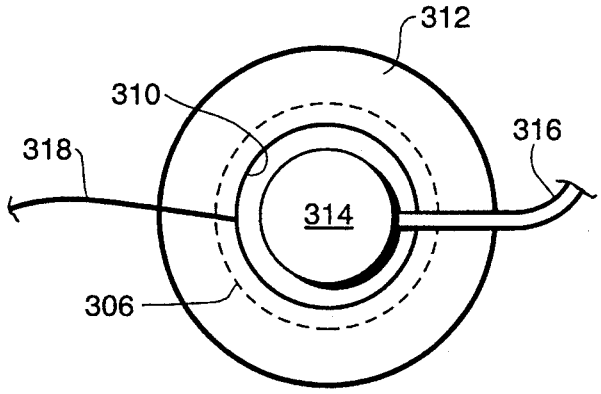
Figure 17:
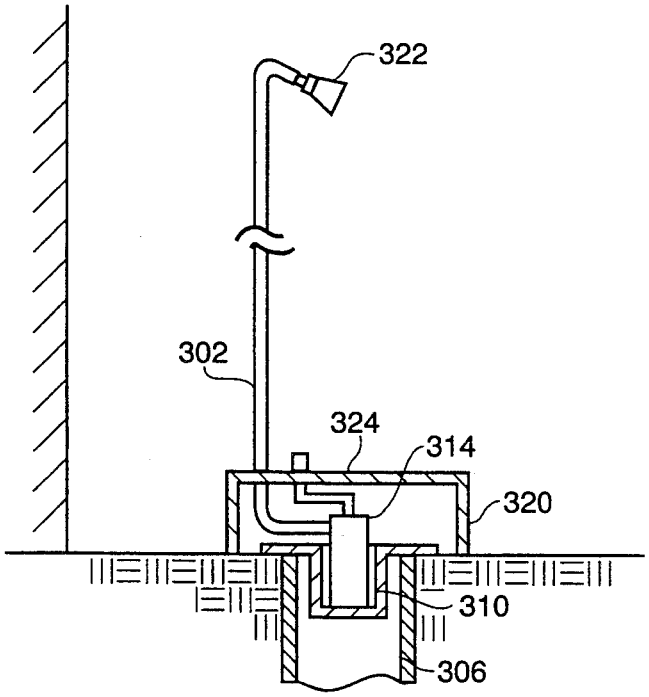
Figure 18:
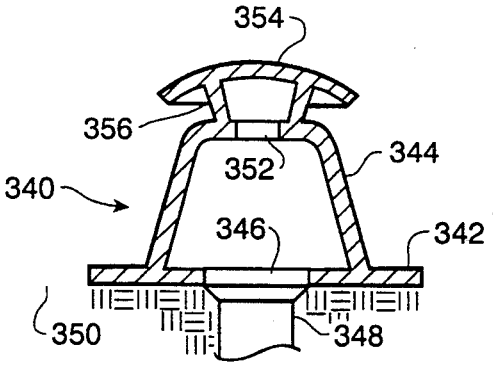
Figure 19:
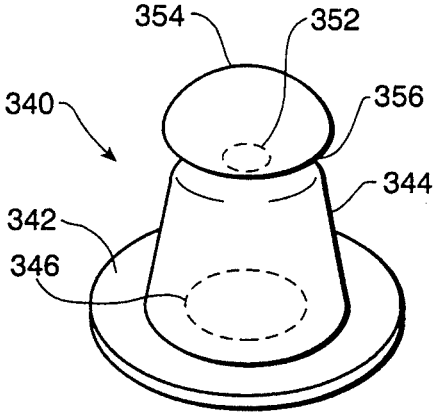
Figure 20:
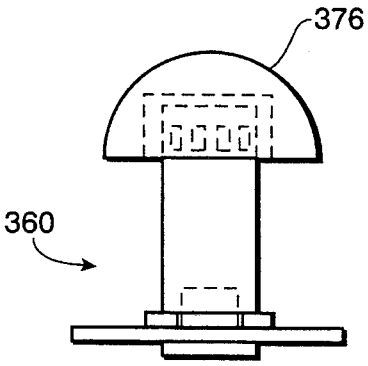
Figure 21:
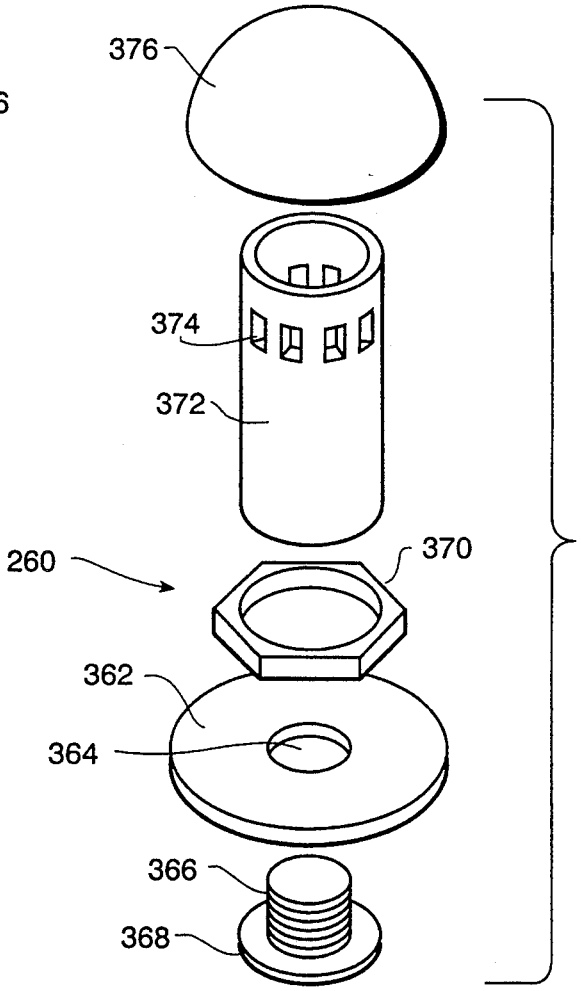
Figure 22:
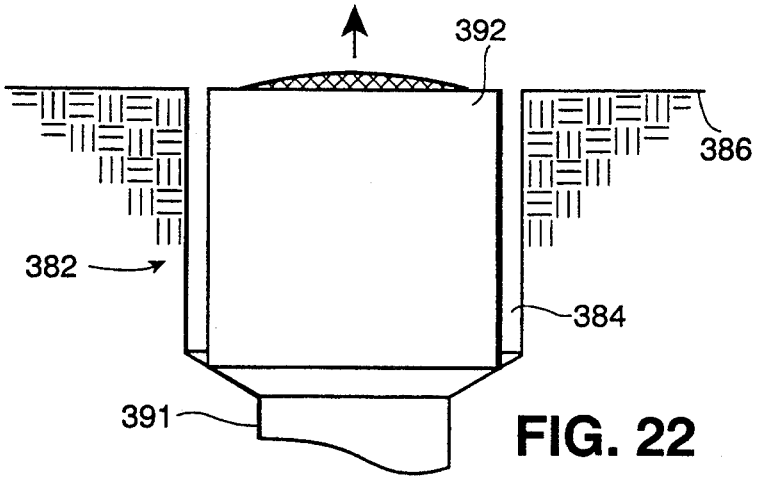
Figure 23:
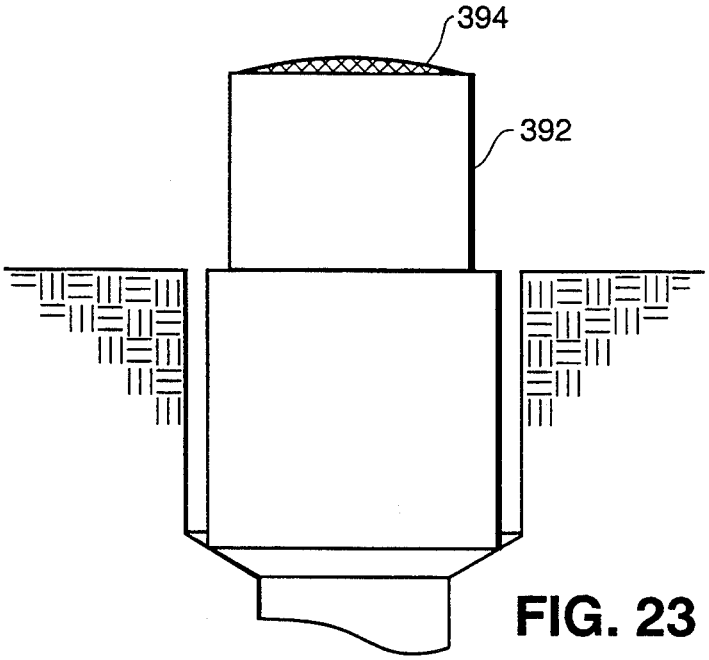
Figure 24:
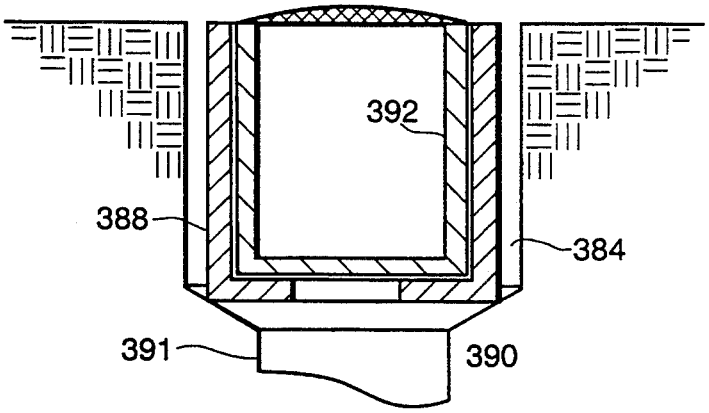

Having thus described the invention in general terms, reference will now be made to the accompanying drawings (eight sheets) in which:

FIG. 1 is a fragmentary side elevational view of a prior art shower head in a shower stall;

FIG. 2 is a fragmentary, somewhat schematic, side elevational view of a water recycling system constructed in accordance with and embodying the present invention;

FIG. 3 is an exploded perspective view showing the major components forming part of one embodiment of a water recycling system constructed in accordance with and embodying the present invention;

FIG. 3A is an exploded perspective view showing certain of the components of FIG. 2 used in an arrangement whereby auxiliary shower heads may have both vertical and horizontal swivel adjustment;

FIG. 4 is a fragmentary exploded side elevational view showing some of the components of a modified form of water recycling system constructed in accordance with and embodying the present invention;

FIG. 5 is a side elevational view, partially broken away and sections, of a alternate pumping arrangement used with the water recycling system of the present invention;

FIG. 6 is an exploded fragmentary side elevational view showing still another embodiment of a water recycling system constructed in accordance with and embodying the present invention;

FIG. 7 is an exploded fragmentary side elevational view showing the embodiment of FIG. 6 in a different orientation;

FIG. 8 is an exploded side elevational view showing the arrangement of components in still a further modified form of water recycling system, based on the arrangement of the system in FIGS. 6 and 7, and also constructed in accordance with and embodying the present invention;

FIG. 9 is a side elevational view of a portion of a foot control pumping mechanism used with the water recycling system of the present invention;

FIG. 10 is an exploded fragmentary side elevational view showing still a further embodiment of a water recycling system constructed in accordance with and embodying the present invention;

FIG. 11 is a fragmentary side elevational view, showing the embodiment of the water recycling system of FIG. 10 with a pair of dual spray heads;

FIG. 12 is a fragmentary side elevational view showing another modified form of water recycling system utilizing a heater member incorporated therein;

FIG. 13 is a fragmentary side elevational view of a water recycling system as part of a permanent installation thereof;

FIG. 14 is a fragmentary side elevational view of still another modified form of water recycling system constructed as a stand-alone unit;

FIG. 15 is a fragmentary sectional view showing the use of an in-drain pump arrangement located within the drain of a shower stall;

FIG. 16 is a top plan view taken substantially along the plane of line 16—16 of FIG. 15;

FIG. 17 is a fragmentary, somewhat schematic, side elevational view showing still another modified form of the invention used as a stand-alone unit;

FIG. 18 is a vertical sectional view showing one form of drain control member constructed in accordance with and embodying the present invention;

FIG. 19 is a perspective view of the drain control member of FIG. 18;

FIG. 20 is a side elevational view of an alternate form of drain control member constructed in accordance with and embodying the present invention;

FIG. 21 is an exploded, somewhat perspective view showing the components of the drain control member of FIG. 20;

FIG. 22 is a fragmentary side elevational view of still a further form of drain control member constructed in accordance with and embodying the present invention;

FIG. 23 is a fragmentary side elevational view showing the drain control member of FIG. 22, but in the raised position;

FIG. 24 is a vertical sectional view showing the construction of the drain control member of FIGS. 22 and 23; and FIG. 25 is a side elevational view of still a further embodiment of a drain control member constructed in accordance with and embodying the present invention.

DETAILED DESCRIPTION OF PREFERRED EMBODIMENTS

Referring now in more detail and by reference characters to the drawings which illustrate several embodiments of a hot water recycling system, reference will first be made to FIG. 1 which shows a typical prior art hot water spray head in a shower stall. In accordance with FIG. 1, it can be observed that a mixed hot and cold water supply pipe 20 extends outwardly from a vertical wall 22 and is provided at its outer end with a conventional shower head 24 for issuing hot water. Typically, the shower head may be provided with a control mechanism 26 for adjusting the type of water spray issuing from the head 24. In addition, a manually operable control valve 28 is located in the shower stall for the user to control both the amount of hot water which may be mixed in proportion in selected amount of cold water to achieve water of a desired temperature, as well as possibly controlling the flow rate thereof.

The hot water recycling apparatus and the method therefor, which is to be hereinafter described, is useful both with new shower installations where it can be incorporated directly in the shower installation, or otherwise as a retro-fit apparatus for use in existing shower stalls. In this case, the apparatus of the invention is designed so that it is effectively universal, that is, it can fit with, and operate in conjunction with, almost any conventional type of shower equipment.

The water recycling system of the present invention is not only effective for use in household environments, it is also effective for use in mobile homes, boats and the like. Thus, in any facility where hot water can be used, as for example, in a shower bathing environment, the water can be recycled in accordance with the present invention. As indicated previously, the water recycling or recirculating system of the present invention is highly effective for use in mobile vehicles such as boats, airplanes, campers, trailers, motor home vehicles and the like. In general, the hot water recirculating system of the invention can be used in essentially any environment in which there is a source of water which may be employed for shower bathing facilities or other similar purposes.

As used in the present invention, the term "shower stall" is used in a broad sense to refer to any environment in which a shower head is located for issuing hot water used for purposes of bathing. Thus, the term "stall" is not limited to a particular enclosed chamber, but would include bathtubs having shower heads installed in connection therewith, shower bathing rooms having a plurality of shower heads and the like.

The hot water recycling apparatus of the present invention is illustrated in a broad schematic form in FIG. 2 and is shown as being located in a conventional shower stall 30 having an enclosing side wall 32 and a floor 34. A drain opening 36 is located at the bottom wall and is usually provided with a conventional filter grill 38 for purposes of preventing large objects from falling into the drain pipe leading from the shower stall.

The shower stall 30 is also conventionally provided with a water supply pipe 40 having a conventional shower head 42 connected thereto. Control valves 43 in the shower stall 30 would be used to control both the amount of hot water or cold water issuing from the shower head 42.

The present invention, in a broad sense, utilizes a manifold 44 which is connected to a diverter valve 46, as illustrated. Also connected to the manifold are one or more auxiliary shower heads 48. Thus, fresh hot water may issue from the shower head 42, or otherwise or in addition, recycled hot water may issue from the shower head 48, in a manner to be hereinafter described in more detail.

A drain control member 50 is located in the shower stall and disposed over the drain opening 36. This drain control member, which is hereinafter described in more detail, is designed to allow water collected in the catchment area of the shower stall to drain after water has accumulated to a certain depth. In this case, the catchment area is generally that area defined by the floor or base wall 34, along with a lower portion of the enclosing side wall 32. Thus, by using the drain control member 50, water can accumulate to a desired depth, e.g. one-half inch to about three inches so that water can be recycled to the issuing shower head 48.

A pump 52 is located in the shower stall and is provided with a screened water inlet 54 on the bottom wall of the pump for pumping water through a recycle water delivery tube 56 which is, in turn, connected to the manifold 44. In this way, hot water which is collected in the catchment area of the shower stall can be pumped to the auxiliary shower head 48 for reissuance through the shower head 48.

The recycled water delivery tube is usually of a flexible tube construction. However, the tube itself could be of a rigid construction, particularly with the stand-alone water recycling units, as hereinafter described.

The pump 52 may be suitably connected to any source of power for operation of the same. In one of the preferred forms of the invention, the pump 52 is connected to a suitable source of 110 volt AC electrical power through an electrical conductor 58. In like manner, the pump 52 may also be of a pneumatic or hydraulic-type operation such that a source of air under pressure or an alternate source of water could be used for operating the pump itself.

The hot water recycling system illustrated in FIG. 2 and the attendant description with regard to same, illustrate and describe a general and overall generic version of the hot water recycling system of the present invention. In essence, and in accordance with this recycling apparatus, fresh hot water which has issued from the shower head 42 may be collected in the catchment area of the shower stall and pumped to an auxiliary shower head 48 for issuance from this auxiliary shower head 48.

In a preferred embodiment of use, a user of this hot water recycling system would initially soap and wash the soap lather off with fresh hot water. After the fresh hot water has drained from the shower stall, the user could then stand in the shower stall and issue hot water for a short time period, e.g. a few minutes, until hot water has collected in the catchment area with the drain control member 50 disposed over the drain 36. Thereafter, the collected and issued fresh hot water which has been collected in the catchment area, would then be recycled for reissuance from the auxiliary shower head 48.

From time to time, an additional amount of fresh hot water could be issued via the diverter valve 46 into the manifold 44 and to the auxiliary shower heads 48 in order to maintain a certain desired temperature of the water which is combined. In this way, a user of the shower system could take a shower of a long duration without wasting a precious water resource and also without wasting the attendant energy used for the heating of water. Rather, the energy required to heat the water is only a relatively small amount of energy, since the water which is being re-heated is already quite warm. Moreover, substantial quantities of water are permitted to issue from the auxiliary shower head 48, depending upon the size of the pump which is used.

It should also be understood in connection with the present invention and as will be illustrated and described in one or more of the following embodiments that the recycled hot water could be mixed with fresh hot water and reissued from a single or double shower head. Moreover, the present invention also contemplates various embodiments of auxiliary shower heads where one or two or more shower heads could also be employed as desired.

Turning now to several more detailed embodiments of the invention, FIG. 3 illustrates in exploded perspective view, some of the major components forming part of a hot water recycling system constructed in accordance with and embodying the present invention. In FIG. 3, it can be seen that a fresh hot water supply pipe 60 (often referred to as a "stem") may extend from a wall of a shower stall and would conventionally be connected to an existing shower head 62. While the shower head 62, as illustrated in FIG. 3, may be a large flow-rate, non-conservation shower head, it should be recognized that, in may regions, particularly where the recycling system of the invention is used, this shower head would be a low-flow rate so-called "water restriction" or "water conservation" shower head. It should also be understood that by using an additional elbow arrangement connected to the elbow 88, it is possible to rotate the heads 72 to spray in angular relationship to one another. In an optional installation or configuration, the stem 60 could be removed and replaced with a relatively short 45 degree elbow, if the installed shower arrangement, utilizing the recirculating system, results in a shower head height that is too low for sufficient comfort.

In accordance with the present invention, a manifold assembly 64 is interposed between the outlet of the fresh hot water pipe 60 and the shower head 62. One of the major components of this manifold assembly 64 is a diverter valve 66 which is in the form of a T-type fitting, but which is, in fact, a manually actuable valve. The valve 66 has one end connected to the supply pipe 60 and another end connected to the existing shower head 62. In this way, when the valve is in a fresh water flow position, water will flow directly through the valve 66 from the supply pipe 60 and to the shower head 62.

The position of the valve 66 may be changed to a recycle flow position by means of a manually actuable lever 68. In this case, fresh hot water from the supply pipe 60 could flow through a T-outlet 70 of the diverter valve 66 and ultimately into auxiliary shower heads 72, through the plumbing components shown in FIG. 3. Otherwise the valve 66 could be operated to cut off the flow of fresh water. The diverter valve could be constructed to regulate the amount of hot fresh water allowed to flow in accordance with manual operation by the user. In this respect, the manifold assembly 64 actually serves as a type of mixing chamber for the mixing of both fresh and recirculated water.

A one-way control valve such as a check valve 74 is connected to the T-arm outlet 70 of the diverter valve 66. In this way, recirculating water, which is returning to the auxiliary shower heads 72, cannot back up into the existing supply line, that is, into the supply pipe 60. In this way, there is assurance that the fresh hot water will not be polluted with so-called "gray water."

In order to enable the hot water recycling apparatus of the invention to be useable with a plurality of different shower stalls, a quick disconnect assembly comprised of a quick disconnect fitting 76 and a quick disconnect coupler 78 are also connected to the T-arm 70 of the diverter valve 66. The fitting 76 and the disconnect coupler 78 actually operate to form a type of quick disconnect fitting arrangement. The coupler 78, for this purpose, is provided with locking cam arms 79 which permit a releasing and a cam-tightening action. Thus, by using this quick disconnect arrangement, it is possible to very easily and quickly remove the hot water recycling apparatus and connect the same to another existing shower stall. Naturally, this quick disconnect arrangement is auxiliary and is not necessarily required in the apparatus of the present invention. Nevertheless, any type of connector may be employed and is not necessarily required to be of the "quick-disconnect" type.

Connected to the outlet of the quick disconnect coupler 78 is an optional adapter bushing 80, along with a flow restricter plug 82 for connection to a so-called "cross fitting" 84. The auxiliary shower heads 72 are connected to a pair of outlets of the cross fitting 84 through nipples 86, pipe elbows 88 and additional nipples 90. Thus, and through this path, it can be observed that water from the T-arm 70 of the diverter valve 66 can flow directly to each of the auxiliary shower heads 72 for issuing fresh hot water therefrom, as well as from the existing shower head 62.

FIG. 3 illustrates an arrangement in which a large number of individual components are employed. This system is highly effective and essentially shows how one can construct this system from commercially available plumbing supply components. However, it should be understood that many of the components illustrated in FIG. 3 would be combined for a mass production system, such that many of the components would be offered as a single unit.

It should also be understood that the shower head 72 could also be connected to the nipples 90 through swivel joints or the like. In this way, the shower head 72 could be swiveled, that is pivotally moved to a desired position. It should also be understood that either one or a pair of elbows may be connected between the fitting 90 and the shower heads 72. This would permit a swivel-type action in which the shower heads could be directed to spray angularly outwardly with respect to one another. In this way, a pair of parties could simultaneously shower with essentially the same shower water.

FIG. 3A illustrates an arrangement in which an additional elbow 91 is connected to the fitting 90 and also to the auxiliary shower head 72. This elbow 91 would be connected to the fitting in such manner that it is quite capable of swiveling about the fitting 90 with respect to the central axis of the fitting 90. In accordance with this construction, it can be seen that the auxiliary shower head 72 can be pivoted with respect to a vertical axis. Moreover, this type of nipple and elbow arrangement allows the auxiliary shower head to be shifted both horizontally as vertically, to provide both vertical and horizontal adjustment. Where sufficient flow rate capacity is available, this arrangement is highly effective in allowing two people to shower together and with each still utilizing a separate auxiliary shower head.

Connected to the fourth arm of the cross fitting 84 is an adapter 92 of the type often referred to as a "hose to slip adapter" and a hose clamp 94 for retaining one end of a hot water recycling tube 96. The opposite end of the recycling tube, which may be in the form of a heavy-duty vinyl hose, is connected to a conventional pump 98. Typically, a hose clamp 100 is sufficient to secure the lower end of the recycled hot water tube 96 to a fitting 102 forming a part of, or otherwise connected to, the conventional pump 98. There are several conventional pumps which are effective for use in the hot water recycling apparatus of the invention. Generally, a small lightweight pump is sufficient for pumping the quantity of hot water required for issuance through the auxiliary spray heads 72. The pump 98 is provided with an inlet and over its inlet with a wire mesh or equivalent filter 104. In the present invention, it can be observed that the inlet of the pump 98 is a downwardly facing inlet. Again, a removable hose clamp or sleeve 106 may be sufficient for retaining the filter over the inlet of the pump 98. The pump 98 is suitably connected to a source of electric power, as hereinafter described, through electrical conductors 108. These conductors 108 may be connected through a ground-fault interrupter 110 for safety purposes and then to a wall outlet 112, or the like.

FIG. 3 illustrates each of the major components forming part of the water recycling apparatus as aforesaid in one embodiment of the invention. In this particular embodiment, the pump is operable through a 110 volt outlet source of electrical power and a pair of reissuing auxiliary shower heads are used. Moreover, a quick disconnect arrangement is also provided. As indicated previously, one or more auxiliary shower heads may be employed or otherwise, a single existing shower head 62 may be used for issuing either recycled hot water or fresh hot water and both.

FIG. 4 illustrates an embodiment of the invention in which a submergible pump 120 is employed and which includes an internally located electric motor 122. The pump has a lower inlet 124 with a filter screen 126 located over the inlet. A suitable electrical conductor 128 is located within the submergible pump 120 and is connected to the electric motor 122, as shown. The electrical conductor 128 is actually trained through a hot water recycling tube 130 which is, in turn, connected to a cross fitting 132 substantially similar to the cross fitting 84.

The electrical conductor 128 exits the recycled hot water delivery tube 130 at or near the cross fitting 132 and is connected to a waterproof switch 134 which is, in turn, connected to a power reducer 136. The power reducer 136 itself would be connected to a suitable source of electrical power such as 110 volt AC electrical current. This power reducer 136 or so-called "converter" would be designed to reduce the power to 13.5 volts with 6 amps. Furthermore, a converter is desired in order to enable operation with a DC electrically operable submergible pump 120. In this case, the motor 122 would be a DC motor. Thus, the reducer 136 also serves as an AC to DC converter. It would preferably be employed with a fuse and ground-fault interrupter (not shown), as well.

The remaining portions of the hot water recycling system would be similar to that hot water recycling apparatus illustrated in FIG. 3 of the drawings. Thus, in this case, the fitting 132 would be connected to the auxiliary shower heads 72 and ultimately to a diverter valve 66. It should also be understood that some of the components used in the overall hot water recycling apparatus could be reduced. For example, a flow restricter could be included in the delivery line from the diverter valve to the cross fitting. Further, some of the nipples and couplings could be eliminated if desired. Finally, an anti-syphon valve could be substituted for an existing check valve. The electrical conductors which are used in the hot water recycling apparatus of the invention would preferably be of marine grade electrical conductors, since they are used in a water environment.

FIG. 5 illustrates an embodiment of the invention in which a self-contained pumping system and source of electrical power may be included within a water-resistant housing 140. In this case, it can be observed that the housing 140 includes internally therein a pump 142, having an outlet port 144 for connection a recycle hot water delivery tube 146, the latter of which would be connected to a conventional cross fitting in the manner as previously described. The pump would have one or more inlet ports 148 connected through walls, and preferably the base wall, of the housing 140 with a screen 149 covering the ports, in the manner as illustrated. In this way, water would only enter into the pump 142 itself but not into the interior compartment of the housing 140.

Located within the housing 140 is a suitable battery source of power 148 which may typically adopt the form of a conventional rechargeable battery. Furthermore, a switch 150 is interposed in the connection of the battery to the pump 142. This switch 150 would be normally located on the exterior wall of the housing 140 and typically would protrude through the housing 140 for manual actuation by a user. The battery 148 is also provided with a recharging jack 152 and which also protrudes through the wall of the housing 140 in the manner as illustrated in FIG. 5. In this way, a removable recharging plug 154 may be inserted into the jack 152 for recharging of the battery 148. The recharging plug 154 would is connected to a suitable AC to DC battery charger 156 and which is, in turn, connected to a suitable source of electrical power as, for example, 110 volt AC power.

In accordance with the arrangement as illustrated in FIG. 5, the entire pumping mechanism, including the source of electrical power thereof, can be located in the catchment area of the shower stall. In this way, the entire hot water recycling apparatus is provided as a small compact assembly with the unique feature of being cordless when in operation.

It should also be understood that the arrangement of FIG. 5 could be constructed in a manner where the housing 140 itself is not necessarily water-tight. In this case, a battery source of power 148 would adopt the form of a conventional submergible rechargeable battery. Furthermore, the switch also would be of a type which is water resistant. The switch may preferably be in a form of a float or liquid level type switch which is automatic in operation and does not necessarily protrude through the housing 140. The other components in the housing which is the pump motor itself, would also be of the type which is submergible. In either case, the arrangement as shown in FIG. 5 is highly effective. Further, the battery 148 may also be rechargeable in the same manner as illustrated in FIG. 5, even if it is of the submergible type.

FIG. 6 illustrates an embodiment of the invention in which the hot water recycling apparatus utilizes a single and existing shower head such as the existing shower head 42 and which is normally connected to the suitable fresh hot water supply pipe 40, in the manner as shown in FIG. 2. In this case, a shut-off Y-fitting 160, similar in location but different in function to the previously described diverter valve 66, is interposed between the shower head 42 and the outlet end of the fresh water supply pipe 40.

The shut-off Y-fitting 160 is also provided with a manually actuable switch 162 having a lever arm in the form of a rotatable valve control element. This switch 162 would control an inner valve (not shown) such that fresh hot water from the supply pipe may issue through the shower head 42, or otherwise restrict the fresh hot water that may pass through to the shower head 42. A Y-arm or neck 164 would permit recirculated water to be injected into the same shower head in the manner as shown. In this way, a single shower head may be employed. Thus, fresh hot water from the supply pipe 40, or otherwise recycled hot water from the catchment area of a shower stall, may both be issued through the shower head 42. In this sense, the shut-off Y-fitting 160 operates in a manner slightly different than a diverter valve but nevertheless, serves essentially the same function as the previously described diverter valves.

In order to preclude backflow into the fresh water supply pipe 40, a check valve 166 (shown in dotted lines) may be located in the neck of the shut-off Y-fitting 160 which is connected to the outlet of the supply pipe 40. In like manner, a second check valve 168 may also be located in the neck 164. These check valves may adopt any conventional form of check valve construction and are effective for precluding any of the mixed water from flowing back through the respective pipes.

It is also possible, although not necessary, to include a flow restricter in one or both of the neck sections of the Y-fitting, if desired. These flow restricters would serve the obvious purpose to restrict the amount of water flowing through the shower head 42. Further, manually adjustable flow restricters could be employed, if desired, although in the embodiment as illustrated, flow restricters are not required as such.

Another unique feature of the shut-off Y-fitting 160 in this embodiment of the invention is that it may be provided with a swivel joint 170. This swivel joint 170 is effective to allow a discharge neck 172 of the fitting 160 to swivel and hence, to reposition the shower head 42 at a desired angle with respect to a user. The shut-off Y-fitting 160 is also unique in that it is a slightly modified form of diverter valve which permits a recirculating shower design without the necessity of a complete manifold. In this sense, the fitting is the manifold and the diverter valve and permits the pump to operate either as a floor-mounted pump or as a stem-mounted pump, as hereinafter described. This is particularly useful in installations where the style of the existing hot and cold water valve only permits control of temperature and does not permit control of volume.

FIG. 6 illustrates the discharge neck 172 in general alignment with the inlet neck of the Y-fitting. FIG. 7 illustrates an arrangement where the discharge neck 172 is located at a 90 degree angle with respect to the inlet neck and with the shower head 42 connected thereto. This type of arrangement is effective where the outlet pipe of the shower has an upwardly struck leg, as illustrated in FIG. 7. In some cases, where the outlet pipe, or so-called "stem" is too low, or in other cases where the shower head itself may be too low relative to the height of the user, the swivel joint 170 in this Y-fitting 160 provides a highly useful function.

The Y-fitting 160 is further unique in that it enables a shower head to be located at 45 degrees, regardless of the angle of the existing supply pipe stem. Furthermore, the one-way check valves 166 and 168 are integrated entirely within the Y-fitting 160. Inasmuch as the flow rate itself is adjustable through the flow rate control operated by the lever arm of the manually actuable switch 162, the user can re-adjust the flow rate approximately from zero flow up to about a full rated discharge capacity of the shower head, such as four gallons per minute to six gallons or at a water saver flow rate of one to three gallons per minute. Finally, this Y-fitting 160 is also highly effective in that it is highly compact and has a relatively short length which typically does not exceed about three inches.

FIG. 8 illustrates an embodiment of a hot water recirculating apparatus constructed in accordance with and embodying the present invention and which is similar in operation and function to the hot water recirculating system described in connection with FIGS. 6 and 7. In this case, there is a Y-fitting 180 which is similar the Y-fitting 160, except that the various necks of the fitting 180 are located in different angular relationships then those shown in FIGS. 6 and 7. Furthermore, the Y-fitting 180 permits exclusion of the swivel joint 170 which is incorporated in the apparatus of FIGS. 6 and 7. Instead, there is provided a goose-neck tube 182 which extends between the fitting 180 and a shower head 184. In this way, the head 184 can be positioned essentially at any desired location and eliminates the need rigid plumbing fittings.

The arrangement of an inlet neck 186 forming part of the Y-fitting 180 also permits removal of the stem 40 which normally extends from a vertical shower wall. In this case, the inlet neck 186 can fit directly onto a water supply pipe 188 located immediately inwardly of the shower wall in the manner as best illustrated in FIG. 8 of the drawings. This type of arrangement enables a very compact installation. Further, there is essentially no reduction in the height of the shower head as a result of additional plumbing components. Further, a variable height adapter could also be provided for adjusting head location in addition to or in place of the goose-neck 182.

FIG. 9 illustrates an embodiment of the invention in which a pump, such as the pump 52, is controlled by a foot or hand operated switch 200. In this case, a drain control member, such as the drain control member 50, is disposed over the drain opening 36 to allow a minimum level of spent hot water to accumulate within the catchment area of the shower stall 30. Again, a hot water recycle stand pipe, such as the tube or pipe 56, is connected to the pump 52 and ultimately to one or more auxiliary spray heads (not shown in FIG. 9).

In accordance with the construction, as illustrated in FIG. 9, it can be observed that the user of the hot water recycle apparatus can control the operation of the pump 52 and hence, the control of flow from the auxiliary shower heads. This arrangement may be useful where the user wishes to maintain a continuous flow of hot water and to intermittently mix the amount of recycled hot water with the fresh hot water.

It should also be recognized that the switch 200, as illustrated in FIG. 9, could adopt the form of a mechanically actuated foot-operable pump. In this way, in order to eliminate any electrical connections or the like, the user of the hot water recirculating system could continuously press up and down on the foot pedal of a mechanically operated pump, thereby causing a pumping action. Otherwise, the apparatus would operate essentially in the same manner as that utilizing an electrically operable pump.

FIG. 10 illustrates an embodiment of the invention in which there is a single diverter valve 202 interposed between a fresh hot water supply pipe 40 and a conventional shower head, such as the shower head 42. This diverter valve 202 also has a T-arm 204 for connection to a recycle hot water tube 206 which is connected to a pump located in the catchment area of a shower stall. The diverter valve 202 is similarly provided with a push button type control switch 208. Thus, in this way, the user of the diverter valve can automatically issue recycled hot water through the conventional shower head 42 or fresh hot water from the shower head 42. The diverter valve 202 similarly employs a check valve 210 integrally incorporated therein for preventing backflow of recycled hot water from entering into the supply line.

In accordance with the arrangement, as illustrated in FIG. 10, it can be observed that the user can also continuously permit water to issue from the fresh hot water supply pipe 40. This water would be automatically mixed with recycled water carried through the recycle hot water tube 206 to the diverter valve 202. In this way, the diverter valve 202 would function as a type of mixing valve, as well. Further, the control switch 208 could be constructed so that it is manually adjustable and not merely an on-off type switch, such that the amount of fresh hot water could be proportioned with the recycled hot water.

FIG. 11 illustrates an embodiment of the invention in which the hot water recycling apparatus is comprised of a manifold in the form of a cross fitting 220 having a neck 222 for connection to a pump 224, similar to any of the previously described pumps. The fitting 220 would also have a neck 225 for connection directly to a water supply pipe, such as the supply pipe 40. Furthermore, the outlet necks of the cross fitting 220, which functions as a manifold, are connected directly to auxiliary shower heads 226 which are similar to the previously described auxiliary shower heads 48 and 72. It can be observed in accordance with FIG. 11 that suitable elbows 228 and connecting pipes are used to connect the fitting 220 to the auxiliary shower heads 226. In accordance with the embodiment as illustrated in FIG. 11, the pump is located in closely adjacent relationship to the auxiliary shower heads 226. A hot water recycle tube 232 is connected to an inlet end of the pump 224. This tube would have its lower end located in the catchment basin of a shower stall. The pump itself would preferably be of a positive displacement type, capable of essentially sucking up the water in the catchment basin.

The remaining portion of the hot water recycling apparatus is similar to that previously described.

In accordance with the construction illustrated in FIG. 11, it can be seen that is not necessary to locate the pump in the catchment area of the shower stall. Rather, the pump can be located in an unobtrusive position immediately adjacent the shower head. It should also be understood that the fitting 220 could adopt the form of a cross fitting, so that it is connected directly to a diverter valve interposed between a conventional hot water shower head, such as the head 42, and a hot water supply pipe, such as the fresh hot water supply pipe 40.

The pump 224 would include its own internal electric motor which is connected to a suitable source of electrical power. For this purpose, the pump could be operable with 110 volt electrical power, along with a suitable ground-fault interrupter for protection, or it could be operable with low voltage power, such as 12 or 13.5 volt power sources. Here again, the pump could also be operable with DC power or AC power, depending upon the type of motor which is used in the pump. Thus, when the pump is primed, it will automatically pump water which has been collected in the catchment area of the shower stall through the recycle supply tube 232.

FIG. 12 illustrates an embodiment of the water recycling system of the present invention which utilizes one or more in-line heaters. In this case, a fresh water supply line 240 projects outwardly from a shower wall 242 and is provided at its outer end with a conventional shower head 244. A manifold 246 is also interposed between the shower wall 242 and the water dispensing head 244 and which manifold 246 is similar to those previously described manifolds as, for example, the manifold 44. A cross fitting 248 is connected to the manifold 246 and which supports an auxiliary shower head 250.

Inasmuch as fresh hot water is only used at a relatively low water flow rate, if the shower head 244 is any appreciable distance from the actual source of hot water, such as the main building hot water heater, that water can cool materially from the heater to the actual shower head 244. While the cooling rate is the same when water is flowing at a high flow rate, the effect of the reduced temperature is unnoticed because of the substantial volume of water being issued from the water dispensing head. However, where water is emitted at a low flow rate, the temperature drop can be readily noticed. Therefore, an in-line heater, such as a heater 252, may be located in the fresh water supply line 240, as illustrated in FIG. 12. This heater 252 may adopt the form of a cartridge heater which can be located in the line itself, or otherwise connected to the line. Preferably, the heater the is an electrically operable heater, although other types of heaters may be employed. These heaters are only required to raise the temperature of the water no more than about 10 degrees in order to maintain the same temperature of the water at the outlet of the hot water heater.

In the case of the recycled hot water, this water can cool somewhat since it is literally flowing through the air and there will be a resultant heat loss. As a result, it may be desirable to insert an additional hot water heater 254 in a recycle line 256, either in addition to or in place of the heater 252. Thus, additional heat can be added to the recycled water.

FIG. 13 illustrates an embodiment of the invention which shows the water recycling system as forming an integral part of the fresh water supply system as, for example, in a new construction. In these cases, the water recycling system of the invention would literally be incorporated with the conventional building plumbing. In accordance with FIG. 13, there is provided a conventional shower stall 258 having a fresh water supply line 260 on the inner side of a shower wall 262, that is the side which is out of view and usually located in the same space as the wall frame. The fresh water supply line 260 projects through the shower wall 262 and is provided at its outer end with a water dispensing shower head 264. In this case, the water emitting from the shower head 264 is controlled by a valve 266 located in the supply line 260 and which is manually operable through a handle 268 on the shower wall 262.

A manifold 270 is located in the supply line 260 behind the shower wall 262 and out of sight. This manifold 270 is connected to a diverter valve 272 which is also behind the shower wall 262 and out of sight. A manually operable control handle 274 projects through the shower wall 262 and is manually operable by a user of the system in order to operate the diverter valve 272. In accordance with this construction, the water recycling system operates in the same manner as the water recycling system described in connection with FIG. 3 and, for that matter, in connection with FIG. 12.

A pump 276 is also located behind the wall and is closely adjacent to the bottom of the shower wall 262 and a floor 278 of the shower. The shower would normally be conventionally provided with a drain 280 in the manner as shown. Further, the pump would be provided with an electrical conductor 282 for connection to a suitable source of electrical power.

In additional to the drain 280 which would normally be used with a drain control member 284, there is provided an auxiliary drain 286 permitting a recycling of water through the drain 286 to the pump 276. Thus, when the drain control member 284 is disposed over the drain 280, water would pass through the drain 286 and would be pumped to the manifold 270 in the manner as previously described.

The pump 276 would be located very closely adjacent to both the floor 278 and the lower end of the shower wall 262 so as to immediately collect water drained through the drain 286. In this way, all standing water would be recycled and then drained through the normal drain 280 at the end of any shower cycle.

It can be observed that the previously described embodiments of the water recycling apparatus were effectively designed as retro-fit apparatus, that is, apparatus which can be added to an existing shower bathing facility. Moreover, the apparatus was designed so that it is readily detachable for use on a number of shower bathing facilities or, otherwise, for permanent attachment thereto.

The present invention also provides an embodiment of a water recycling system which is used in conjunction with a fresh hot water supply source, but which constitutes a stand-alone unit. In this case, FIG. 14 illustrates a shower stall 290 having a fresh hot water supply line 292 terminating in a water dispensing head 294. The water recycling system comprises a container 296 having a pump 298 operated by a battery power supply source 300. Spent water in the base of the shower is received at an inlet port of the pump in communication with the exterior of the container 296. This water is pumped through a recycle stand pipe 302 projecting outwardly from the container 296. In this case, the stand pipe 302 may be of a relatively rigid construction and provided at its upper end with an auxiliary shower head 304.

In accordance with this construction, it can be observed that water can be introduced into the shower stall 290 from the fresh hot water supply source 292 and used intermittently with or in simultaneous combination with recycled water passing through the auxiliary spray head 304. Thus, this unit is highly effective in that it is a stand-alone unit, it is portable and can be readily and easily moved from shower to shower or other location without engaging in the necessity of connecting or disconnecting water lines and the like. It should also be understood that the pump 298 could adopt any of the embodiments of the pump previously described.

FIGS. 15 and 16 illustrate a water recycling system which uses a so-called submergible well pump. In this case, it can be observed that a drain 306 extending downwardly from a shower stall floor 308 is provided with a flow sealing cup 310. The cup is also provided with an outwardly extending circularly shaped flange 312. This cup 310 is preferably made of a fairly rigid rubber or plastic material such as a vinyl plastic. The flange 312, unlike the cup 310, is made of a fairly flexible and bendable material. Thus, the flange may be made of a flexible vinyl plastic or like material. The flange 312 may also have polybutadiene incorporated therein to render some additional flexibility and bendability to the material forming part of the cup flange. In this case, the circular flange 312 will act as a seal when bearing against the floor 308 of the shower stall.

When water is running into the shower, it can be observed that it will collect in the cup 310. The well pump is often referred to as a cartridge-type pump inasmuch as it has a cartridge-like appearance. This well pump 314 is disposed in the cup and has an inlet at its lower end. In this way, the cartridge pump 314 is effectively out of the way and does not present a hazard to the occupant of the shower stall. A water recycling hose 316 is connected to the pump and would be connected to a manifold such as the manifold 44 for cooperation with the fresh water supply source. The pump 314 is also provided with an electrical conductor 318 for connection to a suitable source of electrical power in the manner as previously described.

FIG. 17 illustrates another embodiment of a stand-alone unit which remains unconnected to the existing hot water supply line, but which also uses a well pump. Referring to FIG. 17, it can be observed that a cup 310 is disposed in the drain 306 in the manner as described in connect with the embodiment of FIGS. 15 and 16. A well pump 314 is also located in the drain cup 310. In order to eliminate the inconvenience of a water recycle 302 from being in a space occupying position in a small shower stall, the water recycling stand pipe 302 projects through a housing 320 and terminates in an auxiliary shower head 322. A control mechanism 324 also projects through the housing 320 for manual control by a user of the water recycling system.

The housing 320 which is in the nature of a box serves as a seat and can be disposed over the well pump 314 and the drain. Thus, hot water will exit the auxiliary dispensing head 322 while the user sits on the seat of the box-like housing 320. The water stand pipe 302 can be connected to or operate independently of the existing fresh hot water supply line as previously described. In the embodiments illustrated in FIGS. 15–17, suitable drain control features could be incorporated to control the level of water accumulation.

It should be understood that flow restricters could be incorporated in each of the embodiments of the invention as heretofore described. These flow restricters are effective in order to reduce the amount of hot water which may be issued from the primary or even the auxiliary shower heads. They are also effective to reduce the possibility of scalding with excessive hot water. If water from the same source is used at another fixture while fresh hot water is being issued using the hot water recycling apparatus of the invention, there may be a drop in pressure and hence, a drop in water quantity which is issuing from a shower head at any point in time. The flow restricters will minimize the effect of the water pressure and water quantity changes.

It is also possible to incorporate a filter in either the fresh water supply line or the recycle line, or both. The filter has been found to be effective in eliminating the chlorine gas which sometimes results in a hot water shower facility. The chlorine in the hot water, which is conventionally added by municipalities, breaks down and is issued as a chlorine gas. By utilizing a filter in the supply line or hot water line, this problem is substantially eliminated.

It can also be observed that recycled hot water and fresh hot water can be mixed directly in the manifold forming part of the recycling hot water system. Further, the mixing itself could actually occur in the pipes or in a manifold which is connected to a single shower head. In this way, when recycled hot water is mixed with fresh hot water, this essentially eliminates any possibility of scalding which could inadvertently occur when only fresh hot water is being issued from a conventional hot water shower head.

It has been established that a normal shower head will issue approximately five gallons per minute of water. Using the flow restricting show heads which are often mandated by many governmental authorities, the flow rate can be reduced to as much as 2.5 gallons per minute. Even this amount of water can become an excessively large amount of water during the course of one single shower bathing. Further, the heat contained in this hot water is also lost and hence, the energy to create that heat is lost if the hot water is allowed to merely drain into the shower drain.

In accordance with the present invention, it has been found that by recycling the spent hot water, a relatively long shower can be taken since the maximum quantity of fresh hot water which is used is reduced to no more than about one quart per minute. Thus, a user can now take a shower of relatively long time duration without concern for excessive water consumption and, for that matter, energy usage.

The recycling system also includes the advantage of eliminating water surges and sudden water pressure drops as a result of use of water in other portions of a facility such as a household. As a simple example, when one turns on hot water in another location in a house, the hot water issuing from a shower head will suddenly suffer a pressure drop and a volume drop as well. These surges and pressure drops can continue on each occasion where hot water is used at another location in the house itself. Inasmuch as the recycling system utilizes only a very small amount of hot water in conjunction with the recycled water, pressure drops and surges will be almost non-existent.

The flow rate of the fresh hot water can also be adjusted as may be desired by either incorporating an adjustment in the diverter valve or other manifold.

Again, the recycled water flow rate will not materially affect the water conservation or energy conservation since the same recycled water will largely be used. Thus, and in accordance with this type of assembly, the user can take a shower of long time duration and with ample hot water flow.

It can be observed that the water recycling system of the present invention is highly effective for both permanent installation and retro-fit or add-on connection to an existing water system. Furthermore, it may be provided as a stand-alone unit or otherwise, it may be constructed for connection to an existing fresh water supply line. The pump, as previously described, can be either AC operated, DC operated or, for that matter, a hydraulic or a pneumatic pump. Further, the auxiliary shower heads may adopt the form of a single head or a double head. Moreover, the auxiliary shower head may issue recycled water and the fresh water may be issued from the same water dispensing head.

The present invention provides a provision of a heater, if desired, either in the fresh water line or the recycled line, or both or in the portable units previously described. Furthermore, a filter can be disposed in either one or both of these lines. The recycling system is also designed as a portable stand-alone unit as previously described. Thus, the water recycling system can be easily transported from one shower facility to another shower facility.

The present invention also provides several embodiments of drain control members, as best illustrated in FIGS. 18 through 24 of the drawings. These drain control members, as aforesaid, are highly effective in maintaining a maximum level of spent hot water in the catchment area of the shower stall and yet, they will permit drainage therefrom when the water reaches a certain level. One form of drain control member 340 is more fully illustrated in FIGS. 18 and 19 of the drawings. In this embodiment of the invention, the drain control member 340 comprises a vinyl disk 342 which may function as a stopper and which is disposed over the drain hole in the shower floor. An upstanding dome 344 is connected to the disk 342 in the manner as illustrated in FIGS. 18 and 19 and is also disposed over a drain opening 346. By reference to FIG. 19, it can be observed that the drain opening 346 in the disk 342 is in communication with a drain pipe 348 in the floor 350 of the shower stall. The dome 344 is also provided with an opening 352 at its upper end. Disposed over the opening 352 is a shield 354 and which is connected to the dome 344 by a plurality of spaced apart arms 356.

In accordance with the construction as illustrated in FIGS. 18 and 19, it can be observed that water will rise to a level in the catchment area of the shower equivalent to the height of the dome 344. At this point, water will then flow through the opening 352 and the drain opening 346 into the drain pipe 348. Nevertheless, this level is sufficient to allow a desired accumulation of spent hot water in the catchment area of the shower stall.

FIGS. 20 and 21 illustrate a slightly modified form of drain control member 360 and which comprise a vinyl disk 362 similar to the previously described disk 342 and which is provided with a central opening 364. The disk accommodates an upwardly extending threaded pipe section 366 of a fitting 368, the latter capable of being disposed within a drain pipe of a shower floor. In this case, the fitting 368 adopts the form of a thru-hull fitting. Moreover, the disk 362 is retained on the fitting by means of a retaining nut 370. Secured to the disk 362 is an upstanding riser pipe 372 having a plurality of circularly arranged openings 374 in proximity to its upper end. These openings 374 are designed to allow water to flow through the riser pipe 372 into the drain opening when water in a catchment area has reached the level of the openings 374. A protective cap 376 is disposed over the upper end of the pipe 372, but is spaced from the water receiving openings 374.

The pipe 372 could also adopt the form of a flexible corrugated hose section or a plain rigid pipe, if desired, in order to control the overall height thereof. In this latter embodiment, the upper end of the pipe would be open to permit water drainage through the drain of the shower stall. Further, it should be understood that the components of this drain control member 360, as well as the other drain control members described herein, can be made as a single structure or otherwise it can be produced as an integrated unit from a relatively limited number of components which are assembled.

FIGS. 22–24 illustrate another modified form of drain control member 382. This drain control member is preferably permanently constructed in a drain 384, although it could be designed for removable installation in the drain 384.

The drain control member 382 comprises a cup 388 which fits tightly within the drain opening 384. In this way, the cup 388 forms a generally water-tight seal with the wall of the drain 384. The cup is also provided with a drainage opening 390 in alignment with and in communication with a drain pipe 391 extending from the drain opening 384.

Shiftably disposed within the drain cup 388 is a vertically positionable sleeve 392. The sleeve 392 is shown in its upper position in FIG. 23, that is, the position the where the water recycling system is used. The sleeve 392, however, is shown in its lower position, when the water recycling system is not being used, as in FIGS. 22 and 24.

The sleeve 392 tightly fits within the cup 388 in water sealing contact with the interior surface of the side wall of this cup 388. Therefore, when the sleeve 392 is raised to its upper position, water will only flow through a screen opening 394 at the upper end thereof and into the cup 388 and out through the aperture 390 into the drain pipe 391. In this way, the water level within the basin of the shower can be controlled. When it is no longer desired to use the water recycling system, the user can push the sleeve 392 back into its nested position in the cup 388. In this position, water will automatically drain through the screen opening 394 and out through the drainage opening 390 into the drain pipe 392 in a normal condition of use.

FIG. 25 illustrates still a further embodiment of a drain control member 400 which is similar to the previously described drain control members. In this case, the drain control member 400 comprises a somewhat flexible and yieldable plastic plate 402 which fits over the drain of a shower stall and precludes water drainage therethrough. An elongate horizontally extending drain pipe 404 extends outwardly from the plate 402 to essentially one wall of the shower stall. At its outer end, the horizontally disposed drain pipe 404 is provided with an upstanding riser, which serves as a skimmer 406. The drain pipe 404 is slightly inclined downwardly from the riser 406 to the drain itself.

In accordance with the construction, as illustrated in FIG. 25, it can be observed that water will accumulate within the shower stall to a level equivalent to the upper end of the riser or skimmer 406. Thereafter, the water will drain through the riser 406, the drain pipe 404 and into the drain of the shower itself. Further, due to the fact that the riser 406 may be located against the wall of a shower stall, it is essentially out of the way and in an unobtrusive position.

Thus, there has been illustrated and described a unique and novel water recycling system and a method of use of same which permit a reuse of spent hot water in shower bathing environments. This water recycling apparatus and method thereby fulfills all of the objects and advantages which have been sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by letters patent is:

1. A water recycling system for reissuing spent and recycled water in combination with fresh water from a fresh water source in a shower bathing environment, said system comprising:

a) means for issuing fresh water from the fresh water source in a shower bathing facility, b) first water dispensing head means connected to the means for issuing fresh water from the source thereof for dispensing the fresh water and where the water may collect in a catchment area of the shower bathing facility, c) recycling means comprising a recycle tube for recycling water collected in the water catchment area of said facility for reuse thereof, d) a second water dispensing head means located in close proximity to said first water water dispensing head means and being operatively connected to said recycle tube for using the water recycled from the catchment area thereby allowing water from the catchment area to be reused in the shower bathing environment, e) a manifold interposed between the means for issuing fresh water and the first water dispensing head means and the second water dispensing head means for receiving fresh water from the means for issuing fresh water, f) a pumping means adapted to be located in the water catchment area of the shower bathing facility and being connected to a lower end of the recycle tube for pumping spent water in the water catchment area up to the manifold under pressure, g) a diverter valve connected to and operating in conjunction with said manifold and being connected to said recycle tube, for selectively diverting and allowing fresh water from the fresh water source to issue through the first water dispensing head means or the second water dispensing head means, and h) manually actuable means on said diverter valve manipulatable by an operator of said recycling system to selectively divert water between the first and second water dispensing head means and to also control the amount of fresh water and recycled water to simultaneously issue from the second water dispensing head means.

2. The water recycling system of claim 1 further characterized in that the water from the means for issuing fresh water can be issued intermittently with the recycled water issued from the second water dispensing head means.

3. The water recycling system of claim 1 further characterized in that a check valve means is associated with said manifold so that the first water dispensing head means can only issue fresh water.

4. The water recycling system of claim 1 further characterized in that the water recycling system is adapted to be connected to the fresh water source as a new installation.

5. The water recycling system of claim 1 further characterized in that the water recycling system is adapted to be connected to fresh water source as a retro-fit device.

6. A water recycling system for reissuing spent water as recycled water from a water dispensing head in combination with the issuing of fresh water from a source of fresh water, said system comprising:

a) a manifold with means for connection to the source of fresh water;

b) a diverter valve operable by a user of the water recycling system and connected to said manifold for selectively controlling issuance of fresh water from the source of fresh water and recycled water;

c) a recycle conduit means connected to said manifold and diverter valve and having an end capable of being located in a collection area where previously issued fresh water has collected for delivering the previously issued water as recycled water to the manifold and diverter valve;

d) pump means connected to said recycle conduit means for forcing the water in the water collection area to the manifold and diverter valve under pressure;

e) a first water dispensing head means operatively connected to said diverter valve and said manifold for issuing the fresh water and allowing the issued fresh water to be used;

f) a second water dispensing head means located in close proximity to said first water dispensing head means and being operatively connected to the manifold and diverter valve for intermittently issuing fresh water through the manifold and diverter valve and the recycled water and also issuing a mixture of fresh water and recycled water; and g) manually actuable means on said diverter valve manipulatable by an operator of said water recycling system for selectively controlling the issuance of fresh water from the first water dispensing head means or the issuance of fresh water or recycled water or both from the second water dispensing head means and also controlling an amount of fresh water and recycled water in a mixture of the fresh and recycled water to be issued from the second water dispensing head means.

7. The water recycling system of claim 1 further characterized in that the system is adapted to be used in a conventional shower bathing facility having a lower water collection area and a source of fresh water.

8. The water recycling system of claim 7 further characterized in that the pump means is adapted to be located in a drain of the collection area.

9. The water recycling system of claim 7 further characterized in that the pump means is adapted to be located in the water collection area in a water-tight housing and a battery source of power is in said housing for operation of the pump means.

10. The water recycling system of claim 6 further characterized that the fresh water is hot water and the water recycled is warm water.

11. The water recycling system of claim 6 further characterized in that the pump means is operable with conventional dwelling electrical power.

12. The water recycling system of claim 6 further characterized in that the pump means is operable with a battery source of power.

13. The water recycling system of claim 6 further characterized in that the pump means is adapted to be located on a floor of the collection area.

14. The water recycling system of claim 6 further characterized in that in that the pump means is controlled by a manually actuable switch means located within the system.

15. The water recycling system of Claim 6 further characterized in that in that a swivel joint is associated with the manifold to permit desired orientation of the first and second water dispensing head means.

16. The water recycling system of claim 6 further characterized in that said manifold and said diverter valve are located in close proximity to said first and second water dispensing head means for easy manipulation by a user of the system.

17. The water recycling system of claim 6 further characterized in that the means for connection to the source of fresh water includes a quick disconnect means for connecting the recycling system to a fresh water supply pipe which extends from the source of fresh water and is manually operable to be quickly removed from an installation with the fresh water supply pipe and used on another installation.

* * * * *